US011304438B2

(12) United States Patent
Klipfel et al.

(10) Patent No.: US 11,304,438 B2
(45) Date of Patent: Apr. 19, 2022

(54) METHOD FOR PRODUCING A HOMOGENIZED TOBACCO MATERIAL, AND HOMOGENIZED TOBACCO MATERIAL

(71) Applicant: PHILIP MORRIS PRODUCTS S.A., Neuchatel (CH)

(72) Inventors: Yorick Klipfel, St. Saphorin-sur-Morge (CH); Johannes Petrus Maria Pijnenburg, Neuchatel (CH); Michael Elliot Doyle, Ridgeway, VA (US); Juan David Manzur Bedoya, Lutry (CH); Pascal Rausis, Colombier (CH)

(73) Assignee: Philip Morris Products S.A., Neuchatel (CH)

( * ) Notice: Subject to any disclaimer, the term of this patent is extended or adjusted under 35 U.S.C. 154(b) by 119 days.

(21) Appl. No.: 16/560,698

(22) Filed: Sep. 4, 2019

(65) Prior Publication Data

US 2019/0387786 A1 Dec. 26, 2019

Related U.S. Application Data

(62) Division of application No. 15/503,533, filed as application No. PCT/EP2015/070656 on Sep. 9, 2015, now Pat. No. 10,412,989.

(30) Foreign Application Priority Data

Sep. 30, 2014 (EP) ..... 14187204

(51) Int. Cl.
*A24B 15/14* (2006.01)
*A24B 15/10* (2006.01)
(Continued)

(52) U.S. Cl.
CPC ..... *A24B 15/14* (2013.01); *A24B 3/08* (2013.01); *A24B 3/14* (2013.01); *A24B 15/10* (2013.01); *A24C 5/01* (2020.01)

(58) Field of Classification Search
None
See application file for complete search history.

(56) References Cited

U.S. PATENT DOCUMENTS 4,677,994 A 7/1987 Denier
4,821,749 A 4/1989 Toft
(Continued)

FOREIGN PATENT DOCUMENTS

CN 1034306 A 8/1989
CN 1077359 A 10/1993
(Continued)

OTHER PUBLICATIONS

Gillman,Gene,"Determination of Ammonia in Tobacco and Smokeless Tobacco Products", Technical report, CORESTA Smokeless Tobacco Subgroup,24 pages,[Online],Retrieved from Internet,[retr. Sep. 16, 2018],<URL: https://www.coresta.org/sites/default/files/technical_documents/main/STS-CTR_Ammonia_Aug2014.pdf>.(Year: 2014).*

(Continued)

*Primary Examiner* — Dennis R Cordray
(74) *Attorney, Agent, or Firm* — Mueting Raasch Group

(57) ABSTRACT

The present invention relates to a method to produce a homogenized tobacco material for use in a heat-not-burn aerosol-generating article, comprising the steps of:

selecting a first target value for a first tobacco characteristic, said first tobacco characteristic being reducing sugars and the first target value being comprised between about 8 percent and about 18 percent in dry weight basis of a total amount of tobacco present within the homogenized tobacco material;

(Continued)

selecting a second target value of a second tobacco characteristic, wherein the second tobacco characteristic is one of total ammonia and total alkaloids;

blending graded tobacco types so as to form the tobacco blend, each graded tobacco type comprising a predetermined amount of the first and second tobacco characteristics, so that the first and second target values of said first and second tobacco characteristics are obtained in said blend within a predetermined tolerance range;

grinding said tobacco blend into a blended tobacco powder;

forming a slurry comprising the blended tobacco powder; and forming a web of homogenous tobacco web from the slurry.

16 Claims, 6 Drawing Sheets

(51) Int. Cl.

| | |
|---|---|
| ***A24B 3/14*** | (2006.01) |
| ***A24B 3/08*** | (2006.01) |
| ***A24C 5/01*** | (2020.01) |

(56) References Cited

U.S. PATENT DOCUMENTS

| | | | | |
|---|---|---|---|---|
| 5,724,998 | A | 3/1998 | Gellatly | |
| 8,136,533 | B2 | 3/2012 | Mua | |
| 8,863,754 | B2 | 10/2014 | Renaud | |
| 9,102,948 | B2 | 8/2015 | Hashimoto | |
| 2005/0039767 | A1 | 2/2005 | Mua | |
| 2007/0034220 | A1 | 2/2007 | Pandolfino | |
| 2012/0250025 | A1 * | 10/2012 | Moshe | G01N 21/85 356/451 |

FOREIGN PATENT DOCUMENTS

| | | | |
|---|---|---|---|
| CN | 1044853 | C | 9/1999 |
| EP | 2526781 | | 1/1988 |
| EP | 0325476 | | 7/1989 |
| EP | 0565360 | | 10/1993 |
| EP | 2361516 | | 8/2011 |
| EP | 2526787 | | 11/2012 |
| JP | 01-231884 | | 9/1989 |
| JP | 2008-509703 | | 4/2008 |
| JP | 2013-519384 | | 5/2013 |
| WO | WO 2013/178766 | | 12/2013 |
| WO | WO 2013/178766 | A1 * | 12/2013 |

OTHER PUBLICATIONS

Fisher, Phil, "Tobacco Blending", "11a" in: "Tobacco Production, Chemistry and Technology", 1999, Blackwell Science Ltd., Oxford, GB, XP002740632, pp. 346-353 (Year: 1999).*

Third Party Submission in Japan for Application No. 2017-516705 presented on Apr. 9, 2020 (29 pages).

Gillman, G., "Determination of Ammonia in Tobacco and Smokeless Tobacco Products", CORESTA Smokeless Tobacco Subgroup, 24 pages, [Online], retrieved from the Internet, [retr Sep. 16, 2018], URL:https://www.coresta.org/sites/default/files/technical)documents/main/STS-CTR_Ammonia_Aug2014.pdf. (Year: 2014).

PCT Search Report and Written Opinion for PCTZEP2015/070656 dated Nov. 3, 2015 (14 pages).

Fisher, Phil, "Tobacco Blending", "11a" in: "Tobacco Production, Chemistry and Technology", 1999, Blackwell Science Ltd., Oxford, GB, XP002740632, pp. 346-353, Basic chemical components, p. 350, table 11.4.

Office Action issued in China for Application No. 201580049821.7 dated Nov. 10, 2017 (21 pages). English translation included.

"Chemical Encyclopedia, vol. 18" Editorial Committee, p. 340-345, and 348, Chemical Press, 1st edition, No Date.

Office Action issued in Japan for Application No. 2017-516705 dated Sep. 12, 2019 (9 pages).

* cited by examiner

METHOD FOR PRODUCING A HOMOGENIZED TOBACCO MATERIAL, AND HOMOGENIZED TOBACCO MATERIAL

This application is a continuation of U.S. application Ser. No. 15/503,533, filed Feb. 13, 2017, and which is a U.S. National Stage Application of International Application No. PCT/EP2015/070656, filed Sep. 9, 2015, which was published in English on Apr. 7, 2016 as International Publication No. WO 2016/050472 A1. International Application No. PCT/EP2015/070656 claims priority to European Application No. 14187204.4 filed Sep. 30, 2014. A certified copy of European Application No. 14187204.4 filed Sep. 30, 2014, was provided in, and is available in, U.S. patent application Ser. No. 15/503,533 for which certified copy is available in PAIR.

This invention relates to a homogenized tobacco material and to a method for producing a homogenized tobacco material.

In particular, the invention relates to a process for producing homogenized tobacco material for use in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf. The process to form homogenized tobacco material sheets commonly comprises a step in which tobacco dust and a binder are mixed to form a slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. The function of the homogenized tobacco for use in conventional cigarettes is substantially limited to physical properties of tobacco, such as filling power, resistance to draw, tobacco rod firmness and burn characteristics. This homogenized tobacco is typically not designed to have taste impact. A process for making such homogenized tobacco is for example disclosed in European Patent EP 0565360.

In a "heat-not-burn" aerosol-generating article, an aerosol-forming substrate is heated to a relatively low temperature, in order to form an aerosol but prevent combustion of the tobacco material. Further, the tobacco present in the homogenized tobacco material is typically the only tobacco, or includes the majority of the tobacco, present in the homogenized tobacco material of such a "heat-not burn" aerosol-generating article. This means that the aerosol composition that is generated by such a "heat-not burn" aerosol-generating article is substantially only based on the homogenized tobacco material. Therefore it is important to have good control over the composition of the homogenized tobacco material, for the control for example, of the taste of the aerosol. The use of tobacco dust or leftovers from other tobacco productions for the production of homogenized tobacco material for aerosol-generating article is therefore less suitable because the exact composition of the tobacco dust is not known.

There is therefore a need for a homogenized tobacco material and of a new method of preparing the homogenized tobacco material for the use in a heated aerosol-generating articles of the "heat-not-burn" type that is adapted to the different heating characteristics and aerosol forming needs of such a heated aerosol-generating article.

According to a first aspect, the invention relates to a method to produce homogenized tobacco material for use in a heat-not-burn aerosol-generating article, said method comprising the steps of blending graded tobacco types so as to form the tobacco blend, grinding said tobacco blend into a blended tobacco powder, forming a slurry comprising the blended tobacco powder, and forming a web of homogenous tobacco web from the slurry. According to the invention, the method further comprises the step of selecting a first target value for a first tobacco characteristic and a second target value for a second tobacco characteristic. The first tobacco characteristic is reducing sugars and the first target value is comprised between about 8 percent and about 18 percent in dry weight basis of a total amount of tobacco present within the homogenized tobacco material. The second target value is one of total ammonia and total alkaloids. The blending step is performed so that these first and second target values are obtained in the blend within a predetermined tolerance range.

As the tobacco present in the homogenized tobacco material constitutes substantially the only—or the majority of—tobacco present in the aerosol-generating article, the impact on the characteristics of the aerosol, such as its taste, flavour and chemical characteristics derive predominantly from the homogenized tobacco material. According to the invention, therefore, the ingredients for the homogenized tobacco material are blended such that the origin of all elements of the resulting blended tobacco powder is known. This is a significant advantage over conventional reconstituted tobacco sheets, where the exact composition of the tobacco dust that is used for the preparation is not entirely known. The blending of the tobaccos for the production of the homogenized tobacco material therefore allows setting and meeting predetermined target values for certain characteristics of the resulting blend of different types of tobacco, such as, for example, the flavour characteristics. The starting material for the production of homogenized tobacco material for aerosol-generating article according to the invention is mostly tobacco leaf that has thus the same size and physical properties as the tobacco for the blending of cut filler, that is, tobacco leaves.

Accordingly, in order to obtain certain target values, a control of the blend characteristics is performed. One or more chemical characteristics present in the tobacco leaf which are considered to be relevant for the final product are identified and a desired target value for each of the identified characteristics is selected. This target value is a value to be met by the tobacco blend obtained by combining two or more graded tobacco types. Selecting one or more target values allows to influence, to some extent, the characteristics of the aerosol which is formed when the homogenized tobacco material realized according to the method of the invention is used as an aerosol—forming substrate in an aerosol—forming article. In addition, controlling the tobacco characteristics allows to obtain a homogenized tobacco material which, when used as an aerosol forming substrate, may create a highly reproducible aerosol.

Controlling at least two characteristics of the tobacco in the blend, by means of selecting at least two target values, may allow controlling at least some of the compounds present in the aerosol, which means that the aroma or chemical characteristics which depend on the tobacco characteristic are, to some extent, foreseeable and reproducible. The homogenized tobacco material has therefore for example a specific or "flavour" or a reproducible characteristic that defines the homogenized tobacco material itself, similar to how a specific blend characterizes a combustible aerosol-generating article, such as a cigarette.

Alternatively or in addition, the selection of these two characteristics may influence the control of a characteristic of the homogenized tobacco material which does not affect the aroma of flavour, but the way in which it can be processed. It has been found that the control of certain tobacco characteristics not only influences, to some extent, the characteristics of the aerosol, but also the characteristics of the homogenized tobacco material during its processing to obtain the final product. That is to say, the characteristics of the tobacco present in the tobacco blend can be so selected that certain characteristics of the homogenized tobacco material are enhanced or suppressed depending on the type of processing and desired effects and outcome.

The predetermined tolerance range reflects the natural variability of tobacco characteristics from leaf to leaf.

The term "homogenized tobacco material" is used throughout the specification to encompass any tobacco material formed by the agglomeration of particles of tobacco material. Sheets or webs of homogenized tobacco are formed in the present invention by agglomerating particulate tobacco obtained by grinding or otherwise powdering of one or both of tobacco leaf lamina and tobacco leaf stems.

In addition, homogenized tobacco material may comprise a minor quantity of one or more of tobacco dust, tobacco fines, and other particulate tobacco by-products formed during the treating, handling and shipping of tobacco.

Homogenized tobacco material may comprise one or more intrinsic binders, one or more extrinsic binders, or a combination thereof to help agglomerate particles of tobacco. Homogenized tobacco material may comprise other additives including, but not limited to, tobacco and non-tobacco fibres, aerosol-formers, plasticisers, flavourants, fillers, aqueous and non-aqueous solvents, and combinations thereof.

When intended for use as an aerosol-forming substrate of a heater aerosol-generating article, it may be preferred that the homogenized tobacco has an aerosol-former content greater than about 5 percent on a dry weight basis. Preferably, reconstituted tobacco for use in heated aerosol-generating articles may have an aerosol-former content of between about 5 percent and about 30 percent by weight on a dry weight basis.

In the present invention, the slurry is formed by tobacco lamina and stem of different tobacco types, which are properly blended. With the term "tobacco type" one of the different varieties of tobacco is meant. With respect to the present invention, these different tobacco types are distinguished in three main groups of bright tobacco, dark tobacco and aromatic tobacco. The distinction between these three groups is based on the curing process the tobacco undergoes before it is further processed in a tobacco product.

Bright tobaccos are tobaccos with a generally large, light coloured leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio. From a sensorial perspective, bright tobacco is a tobacco type which, after curing, is associated with a spicy and lively sensation. According to the invention, bright tobaccos are tobaccos with a content of reducing sugars of between about 2.5 percent and about 20 percent on dry weight basis of the leaf and a total ammonia content of less than about 0.12 percent on dry weight basis of the leaf. Reducing sugars comprise for example glucose or fructose. Total ammonia comprises for example ammonia and ammonia salts.

Dark tobaccos are tobaccos with a generally large, dark coloured leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. According to the invention, dark tobaccos are tobaccos with a content of reducing sugars of less than about 5 percent of dry weight base of the leaf and a total ammonia content of up to about 0.5 percent of dry weight base of the leaf.

Aromatic tobaccos are tobaccos that often have small, light coloured leaves. Throughout the specification, the term "aromatic tobacco" is used for other tobaccos that have a high aromatic content, for example a high content of essential oils. From a sensorial perspective, aromatic tobacco is a tobacco type which, after curing, is associated with spicy and aromatic sensation. Example for aromatic tobaccos are Greek Oriental, Oriental Turkey, semi-oriental tobacco but also Fire Cured, US Burley, such as Perique, Rustica, US Burley or Meriland.

Additionally, a blend may comprise so called filler tobaccos. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cured Brazil lower stalk.

Within each type of tobaccos, the tobacco leaves are further graded for example with respect to origin, position in the plant, colour, surface texture, size and shape. These and other characteristics of the tobacco leaves are used to form a tobacco blend. A blend of tobacco is a mixture of tobaccos belonging to the same or different types such that the tobacco blend has an agglomerated specific characteristic. This characteristic can be for example a unique taste or a specific aerosol composition when heated or burned. A blend comprises specific tobacco types and grades in a given proportion one with respect to the other.

According to the invention, different grades within the same tobacco type may be cross-blended to reduce the variability of each blend component. According to the invention, the different tobacco grades are selected in order to realize a desired blend having specific predetermined characteristics. For example, the blend may have a target value of the reducing sugars, total ammonia and total alkaloids per dry weight base of the homogenized tobacco material. Total alkaloids are for example nicotine and the minor alkaloids including nornicotine, anatabine, anabasine and myosmine.

For example, bright tobacco may comprise tobacco of grade A, tobacco of grade B and tobacco of grade C. Bright tobacco of grade A has slightly different chemical characteristics to bright tobacco of grade B and grade C. Aromatic tobacco may include tobacco of grade D and tobacco of grade E, where aromatic tobacco of grade D has slightly different chemical characteristics to aromatic tobacco of grade E. A possible target value for the tobacco blend, for the sake of exemplification, can be for example a content of reducing sugars of about 10 percent in dry weight basis of the total tobacco blend. In order to achieve the selected target value, a 70 percent bright tobacco and a 30 percent aromatic tobacco may be selected in order to form the tobacco blend. The 70 percent of the bright tobacco is selected among tobacco of grade A, tobacco of grade B and tobacco of grade C, while the 30 percent of aromatic tobacco is selected among tobacco of grade D and tobacco of grade E. The amounts of tobaccos of grade A, B, C, D, E which are included in the blend depend on the chemical composition of each of the tobaccos of grades A, B, C, D, E so as to meet the target value for the tobacco blend.

The various tobacco types have different chemical characteristics. It is believed that more than 300 chemical constituents are present in tobacco leaves. Within the same type of tobacco, different grades may also have differences in chemical composition. The chemical constituents of tobacco may be influenced by genetics, agricultural practice, soil type and nutrients, weather conditions, plant disease, stalk position, harvesting and curing procedures.

According to the invention, the blending of different types and grades of tobacco is performed in such a way to meet a selected first and second target values. The tobaccos are blended according to specific formulas or recipes that predetermine the percentage of each type and grade to be used so that the selected first and second target values are obtained. The first and second target values can be obtained by a plurality of different recipes, which means that the same target values can be obtained in many different ways using different combinations of tobacco types and grades. Among the plurality of combination, preferably a specific blend recipe is selected in view of additional considerations, such as for example the flavor of the aerosol which is formed when the homogenized tobacco material produced according to the method of the invention is used in the aerosol-generating article. The tobacco characteristic which has been identified and for which a target value has been selected can be measured directly in the tobacco leaves and stems.

A first predetermined tobacco characteristic is the amount of reducing sugars. Reducing sugars may be an indicator for the level of different other compounds in the tobacco such as amino acids. As specific amino-acids may influence the level of certain aerosol constituent, the reduced sugar may be an indirect indicator of certain aerosol constituent. A very high content of reducing sugars in tobacco may be undesirable as it imparts to the aerosol an acidic character. Reducing sugars may increase moisture content in an aerosol and so act as an emollient. The ratio of sugar to alkaloids can be an indicator of a balance of opposing effects and thus serve as a good aerosol quality indicator. A high ratio may tend to indicate mildness and smoothness while a very low ratio may be indicative of a harsh aerosol. If the ratio is too high, it may indicate that the tobacco is considered too mild. A high sugar content combined with a moderate alkaloid content is particularly preferred feature in an aerosol of an aerosol-generating article. A target value for reducing sugars is between about 8 percent and about 18 percent in dry weight basis of the total amount of tobacco present within the homogenized tobacco material. It has been found that this selected target value of the amount of reducing sugars gives a pleasant aroma to the aerosol. Further, it has been found that this selected target value of the amount of reducing sugars enhances the plasticity of the homogenized tobacco material during processing.

During the production of aerosol generating articles comprising homogenized tobacco material from a homogenized tobacco material web, the homogenized tobacco web is typically required to withstand some physical handling like for example, wetting, conveying, drying and cutting. It would be therefore desirable to provide homogenized tobacco web that is adapted to withstand such handling with no or minimal impact on the quality of the final tobacco material. In particular, it would be desirable, that the homogenized tobacco material web shows little complete or partial ripping. A ripped homogenized tobacco web could lead to the loss of tobacco material during manufacture. Also, a partially or completely ripped homogenized tobacco web may lead to machine downtime and waste during machine stoppage and ramp up. Therefore, on one hand the homogenized tobacco material needs to be very homogeneous to avoid defects and tears during the production, and on the other hand it needs to have a tensile strength high enough to withstand the forces acting on the homogenized tobacco material during the processing.

Accordingly, the characteristic of plasticity, which means a rather high tensile strength, is an important aspect for avoiding machine stoppage and increasing the production yield. According to the invention, this aspect can be advantageously controlled by targeting a predetermined value for the reducing sugars that are present in the blend. In summary, it has been found that the amount of reducing sugars not only impact on the flavor of the aerosol, but also on the quality of the homogenized tobacco material when cast and processed.

A further target value, either the amount of total ammonia or total alkaloids, is preferably selected according to the invention. The total alkaloids are an indication of the amount of nicotine in the aerosol. Therefore, controlling the amount of total alkaloids in the tobacco allows controlling the amount of nicotine in the aerosol formed and inhaled while using the aerosol-generating article.

The total ammonia may be, to some extent, an indicator of the total ammonia in the aerosol. Advantageously, said second tobacco characteristic is total alkaloids and said second target value is comprised between about 0.5 percent and about 3.8 percent in dry weight basis of the total amount of tobacco present within the homogenized tobacco material. Preferably, the total alkaloid target value is comprised between about 1.5 percent and about 3.5 percent in dry weight basis of the total amount of tobacco present within the homogenized tobacco material. Nicotine is an alkaloid, thus controlling the amount of total alkaloids in turn may control the amount of nicotine in the homogenized tobacco material. Preferably, said second tobacco characteristic is total ammonia and said second target value is below about 0.2 percent in dry weight basis of the total amount of tobacco present within the homogenized tobacco material. Preferably, the total ammonia content is kept as low as possible. The control of total ammonia in the blend is linked, so some extent, to the control of the chemistry composition of the aerosol delivered when the homogenized tobacco material is in use in an aerosol-generating article. In this way the nicotine delivery in the aerosol is, to some extent, predictable and reproducible.

In a preferred embodiment, the method include the step of selecting a third target value for a third tobacco characteristic, wherein the third tobacco characteristic is total ammonia the third target value is below about 0.2 percent in dry weight basis of the total amount of tobacco present within the homogenized tobacco material. According to the invention, a first and a second target value can be selected, the first target value being a target value for reducing sugars and the second target value being a target value for either total ammonia or total alkaloids. In a preferred embodiment, there are three target values selected, a first target value for reducing sugars, a second target value for total alkaloids and the third target value for total ammonia.

In order to have a better control of a plurality of characteristics of the aerosol and of the process to produce the homogenized tobacco material, all three different target values for reduced sugars, total alkaloids and total ammonia are set and met with the selected blend of different graded tobacco types.

In a preferred embodiment, the blended tobacco powder comprises between about 50 percent and about 100 percent of the total amount of tobacco comprised within the homogenized tobacco material.

The tobacco blend substantially represents the totality or at least the majority of the tobacco present in the homogenized tobacco material. Controlling the characteristics of the tobaccos forming the tobacco blend means controlling the characteristics of at least the majority of the tobacco in the homogenized tobacco material. A proper selection of the target values of the identified tobacco characteristics allows a control of the characteristics of the aerosol formed when the homogenized tobacco material is used as an aerosol former and a control of the homogenized tobacco material production process, due to the fact that the blend indeed contains most of the tobacco of the homogenized tobacco material.

Preferably, the predetermined tolerance range for the first or second target value of the first or second tobacco characteristic is plus or minus 10 percent the selected first or second target value, respectively. For example, where a target value of "x-RD" has been selected in the range of about 8 percent and about 18 percent of dry weight basis of the total amount of tobacco for the reducing sugars, preferably, the blending of the different tobaccos is so precise such that the actual content of the total reduced sugars in the blend is plus or minus 10 percent of "x-RD", within the range of about 8 percent and about 18 percent of dry base weight of the total amount of tobacco. For example, where "x-RD" is about 10 percent, the tolerance range is between about 9 and about 11 percent. More preferably, the range is of about plus or minus 5 percent and even more preferably of about plus or minus 2 percent the target value. Advantageously, the narrower the range is, the higher is the influence on the parameters of the process and, to some extent, on the delivery of the aerosol.

Advantageously, the method comprises the steps of drying the homogeneous tobacco web. A web of homogenized tobacco material is preferably formed by a casting process of the type generally comprising casting a slurry prepared including the blend of tobacco powder above described on a support surface. Preferably, the cast tobacco web is then dried to form a sheet of homogenized tobacco material and it is then removed from the support surface. Preferably, the moisture of said cast tobacco web at casting is between about 60 percent and about 80 percent in weight of the total weight of the cast tobacco web. Preferably, the method for production of a homogenized tobacco material comprises the step of drying said cast tobacco web and winding said cast tobacco web. Preferably, the moisture of said cast tobacco web at winding is between about 7 percent and about 15 percent in weight of the total weight of the tobacco material web. Preferably, the moisture of said homogenized tobacco web at winding is between about 8 percent and about 12 percent in weight of the total weight of the homogenized tobacco web.

Advantageously, the step of grinding said tobacco blend into a blended tobacco powder comprises the step of grinding said tobacco blend to a powder mean size of between about 0.03 millimeters and about 0.12 millimeters. The mean size of between about 0.03 millimetres and about 0.12 millimetres represents the size at which the tobacco cells are at least in part destroyed by the grinding. Moreover, the homogenized tobacco material obtained using the powder of tobacco having this mean size is smooth and uniform. In the following, the term "tobacco powder", is used through the specification to indicate tobacco having a mean size of between about 0.03 millimetres and about 0.12 millimetres.

In order to obtain a homogeneous homogenized tobacco material, the tobacco lamina for the homogenized tobacco material needs to be ground into powder. Too big tobacco particles, that is, tobacco particles bigger than 0.15 millimetres, may be the cause of defects and inhomogeneous areas in the homogenized tobacco web that is formed from the tobacco powder. The effect is increased the thinner the web of tobacco material is. Defects in the homogenized tobacco web may reduce the tensile strength of the homogenized tobacco web. A reduced tensile strength may lead to difficulties in subsequent handling of the homogenized tobacco web in the production of the aerosol-generating article and could for example cause machine stops due to partial or complete tearing of the tobacco web. Additionally, an inhomogeneous tobacco web may create unintended difference in the aerosol delivery between aerosol generating articles that are produced from the same homogenized tobacco web. Therefore, tobacco having a relatively small mean particle size is desired as a starting tobacco material to form the slurry to obtain acceptable reconstituted tobacco material for aerosol-generating articles. Further, it has been found that the aerosolization of substances from the tobacco can be improved if the tobacco powder is of the same size or below the size of the tobacco cell structure. It is believed that fine grinding to 0.05 millimetres can advantageously open the tobacco cell structure.

According to a second aspect, the invention relates to a homogenized tobacco material comprising powder from a blend of graded tobacco types, said blend tobacco comprising between about 50 percent and about 100 percent of the total amount of tobacco included in the homogenized tobacco material. According to the second aspect of the invention, the graded tobacco types are blended such that the reducing sugars in the blend of graded tobacco types have an amount selected between about 8 percent and about 18 percent in dry weight basis of the total amount of the tobacco present within the homogenized tobacco material. Preferably, the blend tobacco comprises between about 75 percent and about 100 percent of the total amount of tobacco included in the homogenized tobacco material. More preferably, the blend tobacco comprises between about 90 percent and about 100 percent of the total amount of tobacco included in the homogenized tobacco material. Most preferably, the blend tobacco comprises between about 95 percent and about 100 percent of the total amount of tobacco included in the homogenized tobacco material. The higher the amount of blended tobacco is in the homogenized tobacco material, the better is the control over the process parameters. The higher the amount of blended tobacco is in the homogenized tobacco material, the better is the influence on the repeatability of the aerosol that may be generated from the homogenized tobacco material.

A web of homogenized tobacco material is preferably formed by a casting process of the type generally comprising casting slurry prepared including the blend of tobacco powder above described on a support surface. Preferably, the cast tobacco web is then dried to form a sheet of homogenized tobacco material and it is then removed from the support surface.

The homogenized tobacco material of the invention has a good tensile strength adapted to withstand the casting and drying process to produce a suitable tobacco web for use in an aerosol-generating article.

Advantageously, in the homogenized tobacco material, the graded tobacco types are blended so that the total ammonia in the blend of graded tobacco types is in an amount below about 0.2 percent in dry weight basis of the total amount of the tobacco present within the homogenized tobacco material.

Preferably, in the homogenized tobacco material, the graded tobacco types are blended so that the total alkaloids in the blend of tobacco types are in an amount comprised between about 0.5 percent and 3.8 percent in dry weight basis of the total amount of tobacco present within the homogenized tobacco material.

Advantageously, in the homogenized tobacco material, said blend tobacco comprises at least about 30 percent of bright tobacco in dry weight of the total amount of tobacco included in the homogenized tobacco sheet. Preferably, in the homogenized tobacco material, said blend tobacco comprises less than about 40 percent of dark tobacco in dry weight basis of the total amount of tobacco included in the homogenized tobacco material. Advantageously, said blend tobacco comprises less than about 40 percent of aromatic tobacco in dry weight basis of the total amount of tobacco included in the homogenized tobacco material. Due to the different properties of the bright tobaccos, the dark tobaccos and the aromatic tobaccos, using the above ranges creates a large design space for different blends. Preferably, the blend tobacco of the homogenized tobacco material comprises less than about 20 percent of filler tobacco in dry weight basis of the total amount of tobacco included in the homogenized tobacco material.

In a preferred embodiment, the homogenized tobacco material comprises cellulose fibers in an amount between about 1 percent and about 3 percent in dry weight basis of the homogenized tobacco material. A cellulose pulp includes water and cellulose fibres. Cellulose fibres for including in a slurry for homogenized tobacco material are known in the art and include, but are not limited to: soft-wood fibres, hard wood fibres, jute fibres, flax fibres, hemp fibres, tobacco fibres and combination thereof. In addition to pulping, the cellulose fibres might be subjected to suitable processes such as refining, mechanical pulping, chemical pulping, bleaching, sulphate pulping and combination thereof.

Fibres particles may include tobacco stem materials, stalks or other tobacco plant material. Preferably, cellulose-based fibres such as wood fibres comprise a low lignin content. Fibres particles may be selected based on the desire to produce a sufficient tensile strength for the cast leaf versus a low inclusion rate, for example, a rate between about 2 percent and about 15 percent. Alternatively fibres, such as vegetable fibres, may be used either with the above fibres or in the alternative, including hemp and bamboo.

During the processing from the slurry to a final homogenized tobacco material to be cut and introduced in an aerosol-generating device, homogenized tobacco sheets are often required to withstand wetting, conveying, drying and cutting. The ability of the homogenized tobacco webs to withstand the rigors of processing with minimal breakage and defect formation is a highly desirable characteristic since it reduces the loss of tobacco material. The introduction of cellulose fibres in the homogenized tobacco material increases the tensile strength to traction of the sheet of material, acting as a strengthening agent. Therefore adding cellulose fibres may increase the resilience of the homogenized tobacco material web and thus reduce the manufacturing cost of the aerosol-generating device and other smoking articles.

Advantageously, the homogenized tobacco material comprises a binder in an amount between about 1 percent and about 5 percent in dry weight basis of the homogenized tobacco material.

It is advantageous to add a binder, such as any of the gums or pectins described herein, to ensure that the tobacco powder remains substantially dispersed throughout the homogenized tobacco web. For a descriptive review of gums, see Gums And Stabilizers For The Food Industry, IRL Press (G. O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

Preferably, the homogenized tobacco material comprises an aerosol-former in an amount between 5 about percent and about 30 percent in dry weight basis of the homogenized tobacco material.

Suitable aerosol-formers for inclusion in slurry for webs of homogenised tobacco material are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

For example, where the homogenized tobacco material according to the specification is intended for use as aerosol-forming substrates in heated aerosol-generating articles, webs of homogenised tobacco material may have an aerosol former content of between about 5 percent and about 30 percent by weight on a dry weight basis. Homogenized tobacco material intended for use in electrically-operated aerosol-generating system having a heating element may preferably include an aerosol former of greater than 5 percent to about 30 percent on dry weight basis. For homogenized tobacco material intended for use in electrically-operated aerosol-generating system having a heating element, the aerosol former may preferably be glycerol.

According to a third aspect, the invention relates to an aerosol-generating article including a portion of the homogenized tobacco material above described. An aerosol-generating article is an article comprising an aerosol-forming substrate that is capable of releasing volatile compounds that can form an aerosol. An aerosol-generating article may be a non-combustible aerosol-generating article. Non-combustible aerosol-generating article releases volatile compounds without the combustion of the aerosol-forming substrate, for example by heating the aerosol-forming substrate, or by a chemical reaction, or by mechanical stimulus of an aerosol-forming substrate.

The aerosol-forming substrate is capable of releasing volatile compounds that can form an aerosol volatile compound and may be released by heating the aerosol-forming substrate. In order for the homogenized tobacco material to be used in an aerosol-forming generating article, aerosol formers are preferably included in the slurry that forms the cast leaf. The aerosol formers may be chosen based on one or more of predetermined characteristics. Functionally, the aerosol former provides a mechanism that allows the aerosol former to be volatilize and convey nicotine and/or flavouring in an aerosol when heated above the specific volatilization temperature of the aerosol former.

The invention also relates to a batch of aerosol generating articles, wherein the first or the second target value of the first or the second tobacco characteristic, respectively, is within a predetermined tolerance range, and the tolerance range is equal to the first or second target value plus or minus about 10 percent of the selected first or second target value, respectively.

Specific embodiments will be further described, by way of example only, with reference to the accompanying drawings in which.

Figure 1:
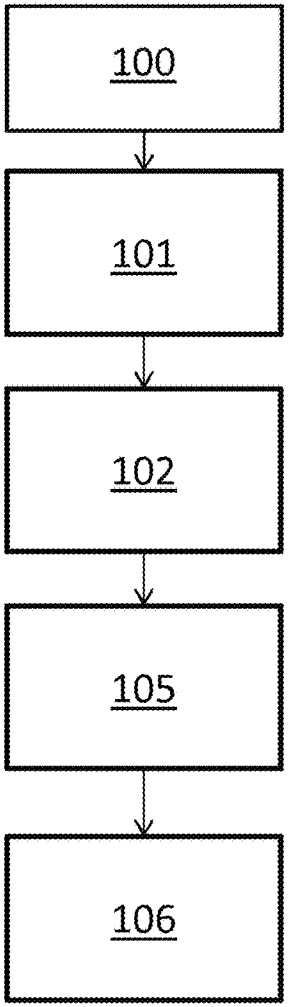
FIG. 1 shows a flow diagram of a method to produce slurry for homogenized tobacco material according to the invention.

With initial reference to FIG. 1, a method for the production of slurry according to the present invention is represented. The first step of the method of the invention is the selection 100 of the tobacco types and tobacco grades to be used in the tobacco blend for producing the homogenized tobacco material. Tobacco types and tobacco grades used in the present method are for example bright tobacco, dark tobacco, aromatic tobacco and filler tobacco.

Only the selected tobacco types and tobacco grades intended to be used in the production of the homogenized tobacco material undergo the processing according to following steps of the method of the invention.

The method includes a further step 101 in which the selected tobacco is laid down. This step may comprise checking the tobacco integrity, such as grade and quantity, which can be for example verified by a bar code reader for product tracking and traceability. After harvesting and curing, the leaf of tobacco is given a grade, which describes the stalk position, quality, and colour.

The tobacco types are either examined in order to obtain the value of some tobacco characteristics of the various tobacco types, or the tobacco characteristics have been already analyzed, for example reported or written down in a bar-code or sticker. These tobacco characteristics include reducing sugars and one of total ammonia or total alkaloids.

The analysis or retrieval of the value of these characteristics is performed for every grade within each tobacco type. For example, the flue-cured tobacco may include a type or grade having a reducing sugars content equal to about 22 percent in dry weight basis and an Ontario flue-cured tobacco having a reducing sugars content of about 18 percent in dry weight basis. The graded tobacco types are used in a tobacco blend 9 formed in a further step of the method of the invention. For the blend, a plurality of target values of tobacco characteristics is set. A target value for the reduced sugar within a range of about 8 percent and about 18 percent in dry weight basis of the total amount of tobacco is selected. Further, preferably a target value for the total ammonia below about 0.2 percent in dry weight basis of the total amount of tobacco is selected. Preferably, also a target value for the total alkaloids comprised between about 1.5 percent and about 3.5 percent in dry weight basis of the total amount of tobacco is selected. Reduced sugar, total alkaloids and total ammonia can be measured directly in the tobacco leaves, so that the percentage of the various types of tobacco to be present in the tobacco blend 9 can be chosen in order to obtain the selected target values.

Further, the lay down step 101 might also include, in case the tobacco is shipped to the manufacturing premises for the production of the homogenized tobacco material, de-boxing or case opening of the tobacco boxes. The de-boxed tobacco is then preferably fed to a weighing station in order to weight the same.

Moreover, the tobacco lay down step 101 may include bale slicing, if needed, as the tobacco leaves are normally transported in bales when boxed and shipped.

The tobacco bales are separated depending on the tobacco type. For example there may be a processing line for each tobacco type. Therefore, the following steps are performed for each tobacco type, as detailed below. These steps may be performed subsequently per grade such that only one production line is required. Alternatively, the different tobacco types may be processed in separate lines. This may be advantageous where the processing steps for some of the tobacco types are different. For example, in conventional primary tobacco processes bright tobaccos and dark tobaccos are processed at least partially in separate processes, as the dark tobacco often receives an additional casing. However, according to the present invention, preferably, no casing is added to the blended tobacco powder before formation of the homogenized tobacco web.

Further, the method of the invention includes a step 102 of coarse grinding of the tobacco leaves.

Figure 2:
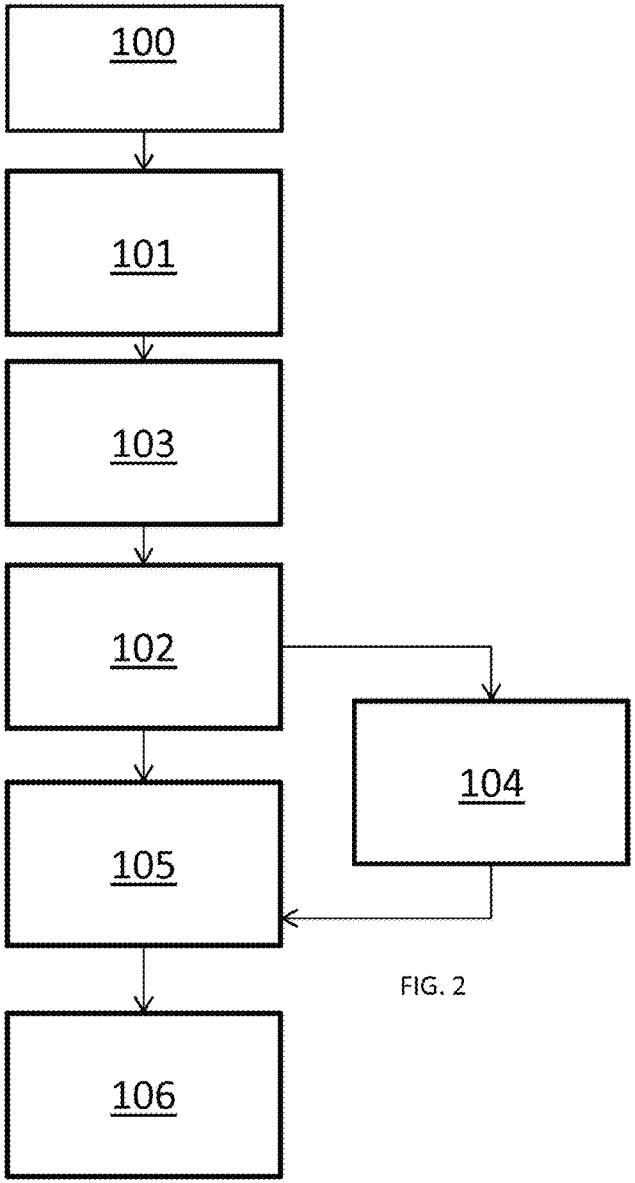
FIG. 2 shows a block diagram of a variant of the method of FIG. 1.

According to a variant of the method of the invention, after the tobacco lay down step 101 and before the tobacco coarse grinding step 102, a further shredding step 103 is performed, as depicted in FIG. 2. In the shredding step 103 the tobacco is shredded into strips having a mean size comprised between about 1 millimetre and about 100 millimetres.

Preferably, after the shredding step 103, a step of removal of non-tobacco material from the strips is performed (not depicted in FIGS. 1 and 2).

Subsequently, the shredded tobacco is transported towards the coarse grinding step 102. The flow rate of tobacco into a mill to coarse grind the strips of tobacco leaf is preferably controlled and measured.

In the coarse grinding step 102, the tobacco strips are reduced to a mean particle size of between about 0.25 millimetres and about 2 millimetres. At this stage, the tobacco particles are still with their cells substantially intact and the resulting particles do not pose relevant transport issues.

The method of the invention may include an optional step 104, depicted in FIG. 2, which includes packing and shipping the coarse grinded tobacco. This step 104 is performed in case the coarse grinding step 102 and the subsequent step of the method of the invention are performed in different manufacturing facilities.

Preferably, after the coarse grinding step 102, the tobacco particles are transported, for example by pneumatic transfer, to a blending step 105. Alternatively, the step of blending 105 could be performed before the step of coarse grinding 102, or where present, before the step of shredding 103, or, alternatively, between the step of shredding 103 and the step of coarse grinding 102.

In the blending step 105, all the coarse grinded tobacco particles of the different tobacco types selected for the tobacco blend are blended. The blending step 105 therefore is a single step for all the selected tobacco types. This means that after the step of blending there is only need for a single process line for all of the different tobacco types.

In the blending step 105, preferably mixing of the various tobacco types in particles is performed. Preferably a step of measuring and controlling one or more of the properties of the tobacco blend is performed. According to the invention, the flow of tobacco may be controlled such that the desired blend according to a pre-set target value or pre-set target values is obtained. For example, it may be desirable that the blend includes bright tobacco 1 at least for about 30 percent in dry weight basis of the total tobacco in the blend, and that dark tobacco 2 and aromatic tobacco 3 are comprised in a percentage between about 0 percent and about 40 percent in dry weight basis of the total tobacco in the blend, for example about 35 percent. More preferably, also filler tobacco 4 is introduced in a percentage between about 0 percent and about 20 percent in dry weight basis of the total tobacco in the blend. The flow rate of the different tobacco types is therefore controlled so that this ratio of the various tobacco types is obtained. Alternatively, where the coarse grinding step 102 is done subsequently for the different tobacco leaves used, the weighing step at the beginning of the step 102 determines the amount of tobacco used per tobacco type and grade instead of controlling its flow rate.

Figure 5:
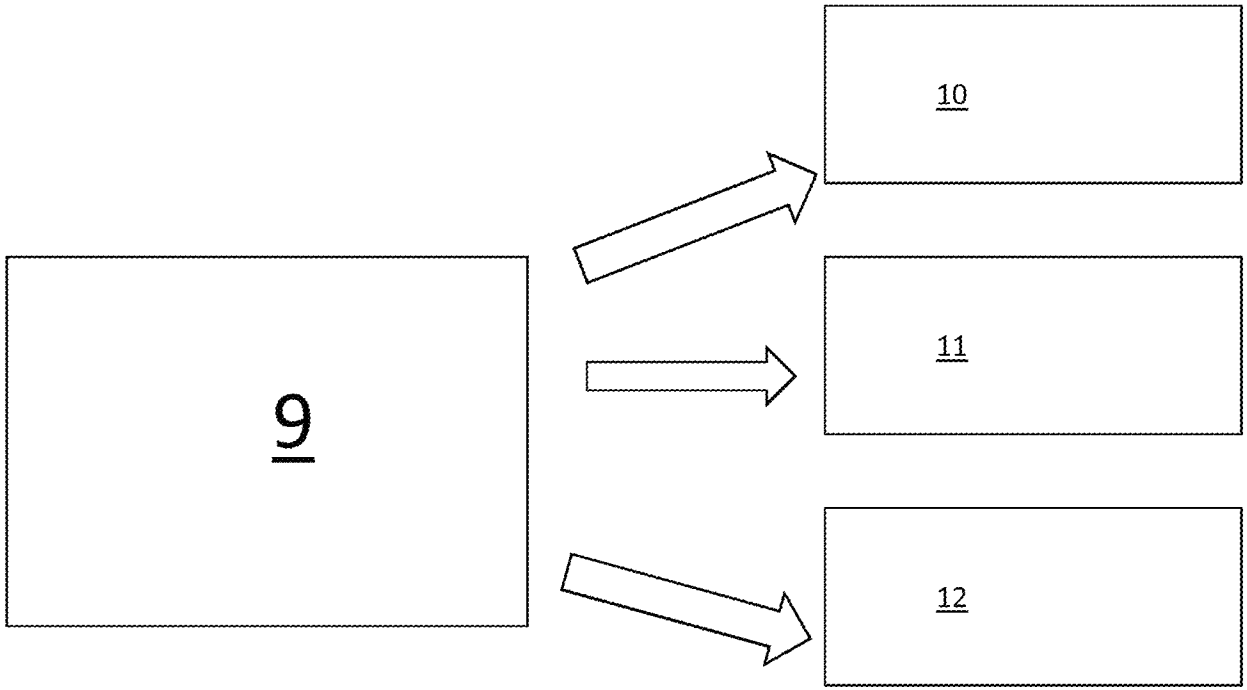
FIG. 5 shows an enlarged view of one of the steps of the method of FIG. 1, 2 or 3.

As shown in FIG. 5, the blend is so prepared that the target values for the reducing sugars 10 and at least for one of the target values for total alkaloids 11 and total ammonia 12 are met. Preferably all three target values are selected, so that the resulting blend has a value of reduced sugar, of total ammonia and total alkaloids at about the selected target values. The first, second and third target values are obtained in the process of the invention within a predetermined tolerance range, said predetermined tolerance range being preferably plus or minus 10 percent the first, second, and third target values, respectively.

Figure 4:
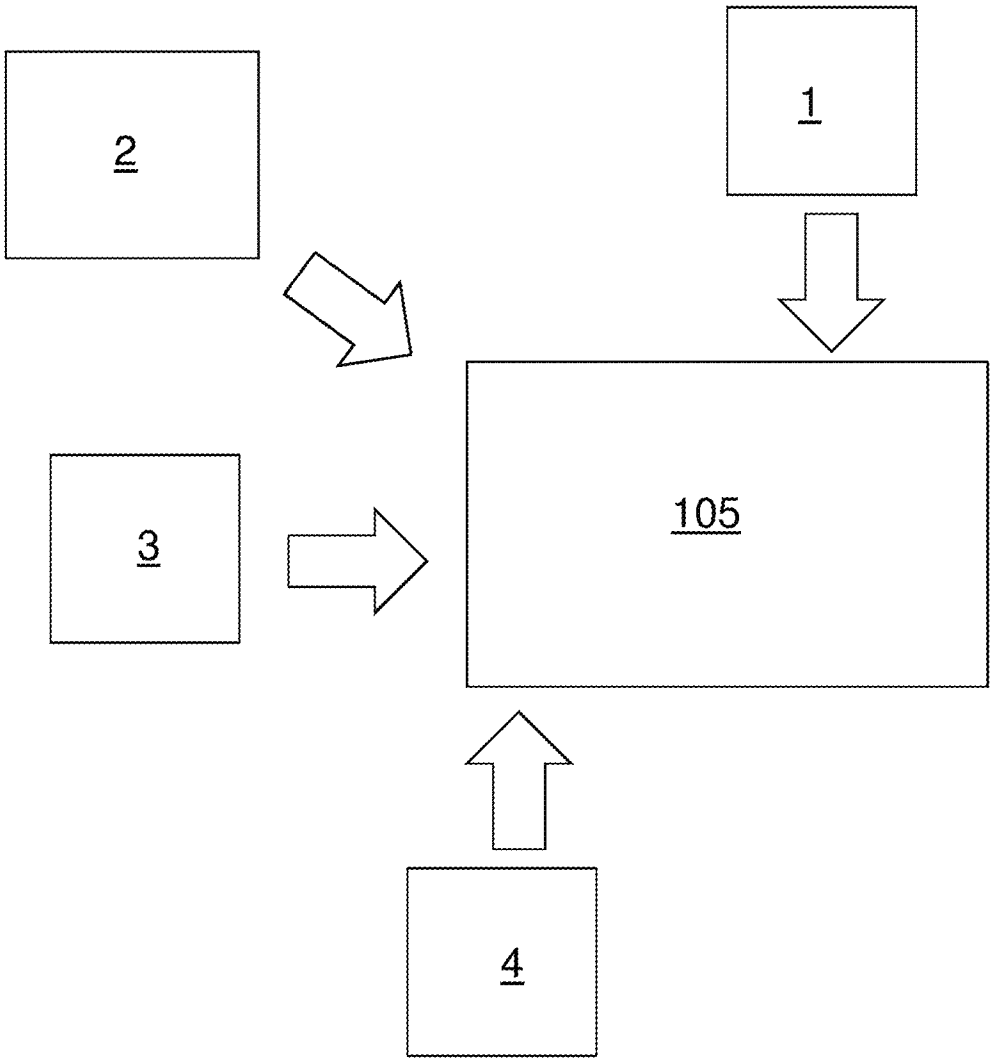
FIG. 4 shows an enlarged view of one of the steps of the method of FIG. 1, 2 or 3.

In FIG. 4, the introduction of the various tobacco types during the blending step 105 is shown. These tobacco types are introduced in such ratios that the above mentioned target values are obtained in the resulting blend.

It is to be understood that each tobacco type could be itself a sub-blend, in other words, the "bright tobacco type" could be for example a blend of Virginia tobacco and Brazil flue-cured tobacco of different grades.

After the blending step 105, a fine grinding step 106 to a tobacco powder mean size of between about 0.03 millimetres and about 0.12 millimetres is performed. This fine grinding step 106 reduces the size of the tobacco down to a powder size suitable for the slurry preparation. After this fine grinding step 106, the cells of the tobacco are at least partially destroyed and the tobacco powder may become sticky.

The so obtained tobacco powder can be immediately used to form the tobacco slurry. Alternatively, a further step of storage of the tobacco powder, for example in suitable containers may be inserted (not shown).

Figure 3:
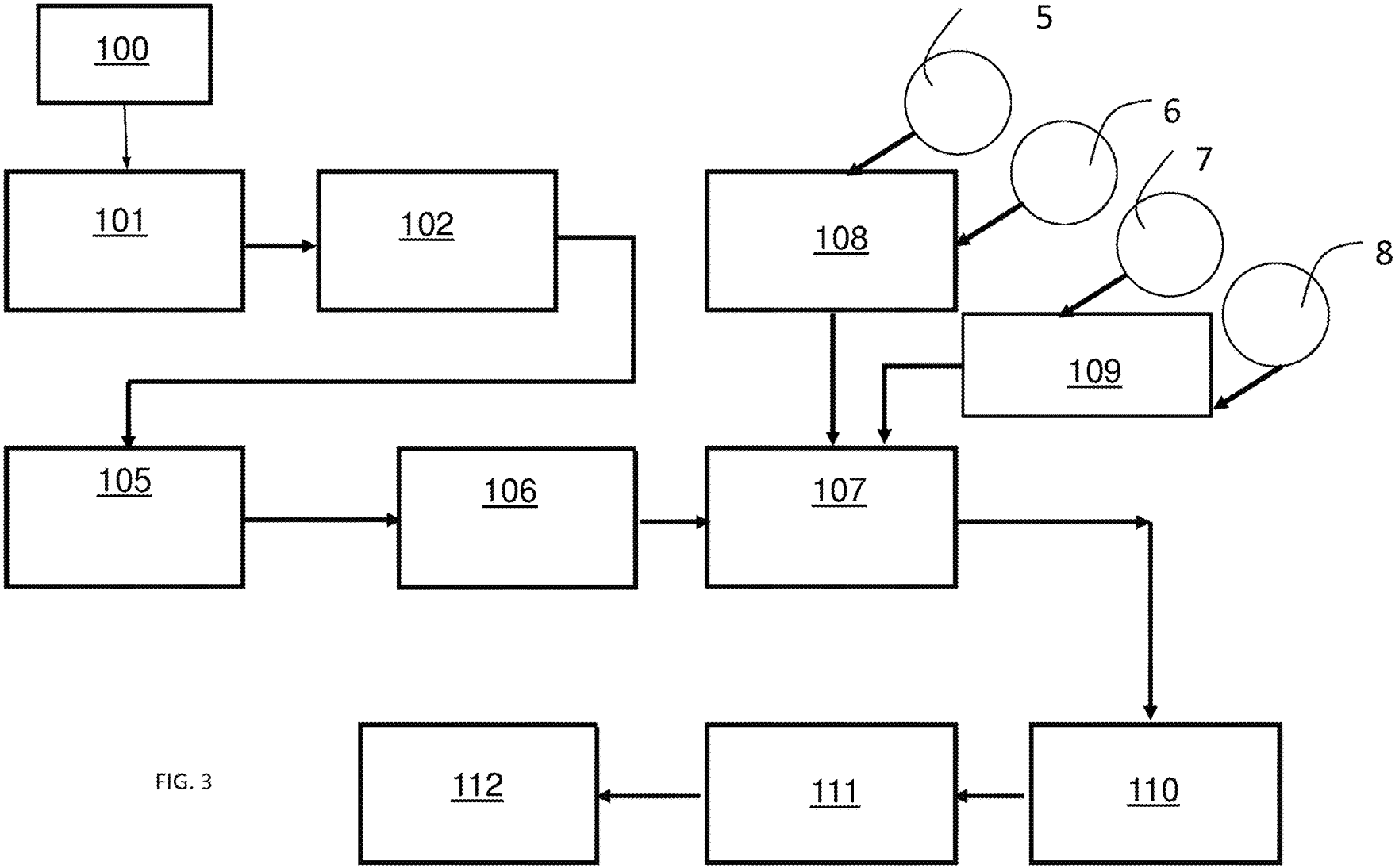
FIG. 3 shows a block diagram of a method for production of a homogenized tobacco material according to the invention.

With now reference to FIG. 3, a method of the invention for a manufacture of a homogenized tobacco web is shown. From step 106 of fine grinding, the tobacco powder is used in a subsequent slurry preparation step 107. Prior to or during the slurry preparation step 107, the method of the invention includes two further steps: a pulp preparation step 108 where cellulose fibres 5 and water 6 are pulped to uniformly disperse and refine the fibres in water, and a suspension preparation step 109, where an aerosol-former 7 and a binder 8 are premixed. Preferably the aerosol-former 7 includes glycerol and the binder 8 includes guar. Advantageously, the suspension preparation step 109 includes premixing guar and glycerol without the introduction of water.

The slurry preparation step 107 preferably comprises transferring the premix solution of the aerosol-former and the binder to a slurry mixing tank and transferring the pulp to the slurry mixing tank. Further, the slurry preparation step comprises dosing the tobacco powder blend into the slurry mixing tank with pulp, and the guar—glycerol suspension. More preferably, this step also includes processing the slurry with a high shear mixer to ensure uniformity and homogeneity of the slurry.

Preferably, the slurry preparation step 107 also includes a step of water addition, where water is added to the slurry to obtain the desired viscosity and moisture.

In order to form the homogenized tobacco web, preferably the slurry formed according to step 107 is cast in a casting step 110. Preferably, this casting step 110 includes transporting the slurry to a casting station and casting the slurry into web having a homogenous and uniform film thickness on a support. Preferably, during casting, the cast web thickness, moisture and density are controlled immediately after casting and more preferably are also continuously monitored and feedback-controlled using slurry measuring devices during the whole process.

The homogenized cast web is then dried in a drying step 111 comprising a uniform and gentle drying of the cast web, for example in an endless, stainless steel belt dryer. The endless, stainless steel belt dryer may comprise individually controllable zones. Preferably the drying step comprises monitoring the cast leaf temperature at each drying zone to ensure a gentle drying profile at each drying zone and heating the support where the homogenized cast web is formed. Preferably, the drying profile is a so called TLC drying profile.

At the conclusion of the web drying step 111, a monitoring step (not shown) is executed to measure the moisture content and number of defects present in the dried web.

The homogenized tobacco web that has been dried to a target moisture content is then preferably wound up in a winding step 111, for example to form a single master bobbin. This master bobbin may be then used to perform the production of smaller bobbins by slitting in a small bobbin forming process. The smaller bobbins may then be used for the production of an aerosol-generating article (not shown).

Figure 6:
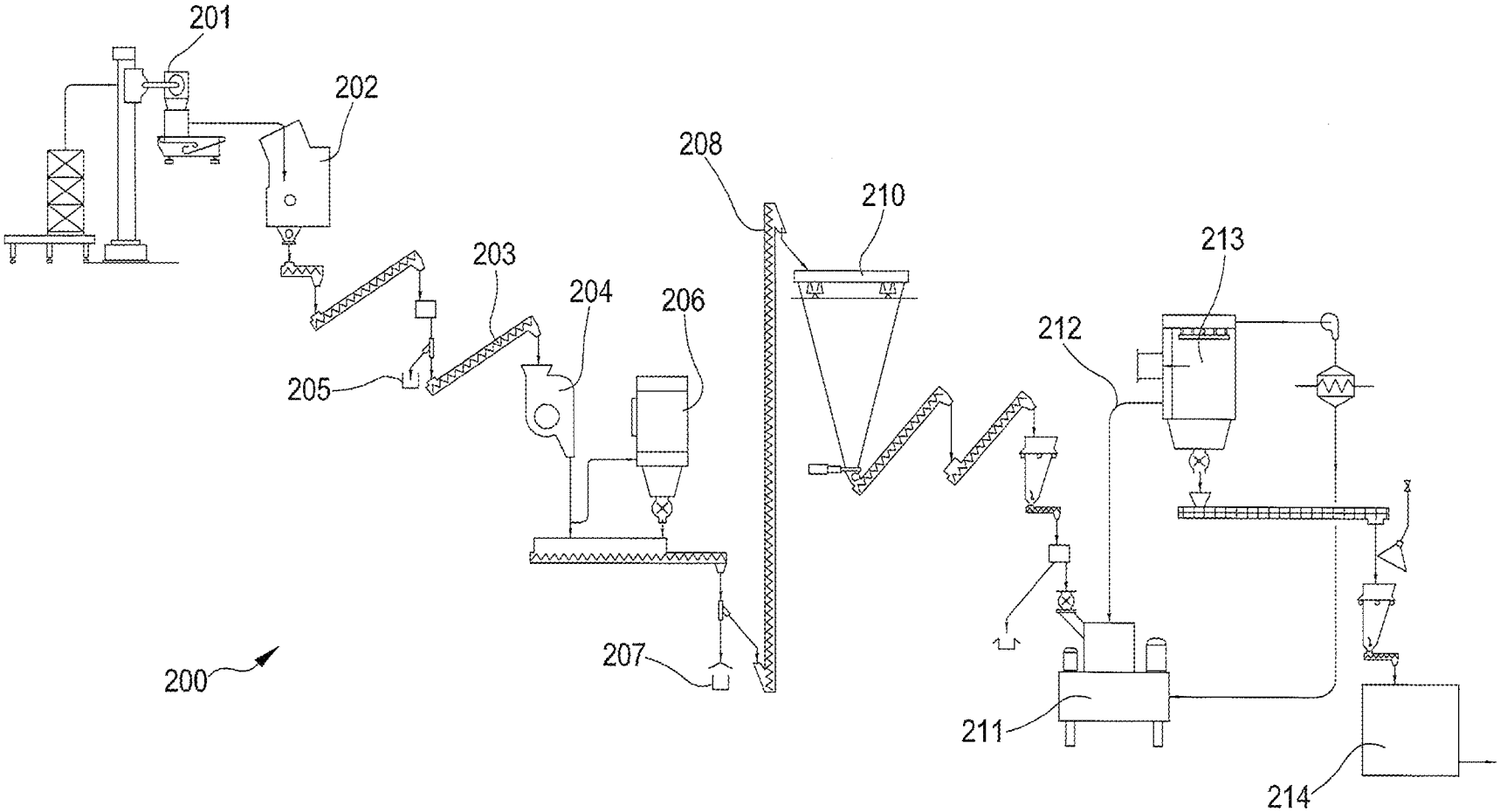
FIG. 6 shows a schematic view of an apparatus for performing the method of FIGS. 1 and 2.

The method of production of a slurry for the homogenized tobacco material according to FIG. 1 or 2 is performed using an apparatus for the production of a slurry 200 depicted schematically in FIG. 6. The apparatus 200 includes a tobacco receiving station 201, where accumulating, de-stacking, weighing and inspecting the different tobacco types takes place. Optionally, in case the tobacco has been shipped into cartons, in the receiving station 201 removal of cartons containing the tobacco is performed. The tobacco receiving station 201 also optionally comprises a tobacco bale splitting unit.

In FIG. 6 only a production line for one type of tobacco is shown, but the same equipment may be present for each tobacco type used in the homogenised tobacco material web according to the invention, depending on when the step of blending is performed. Further the tobacco is introduced in a shredder 202 for the shredding step 103. Shredder 202 can be for example a pin shredder. The shredder 202 is preferably adapted to handle all sizes of bales, to loosen tobacco strips and shred strips into smaller pieces. The shreds of tobacco in each production line are transported, for example by means of pneumatic transport 203, to a mill 204 for the coarse grinding step 102. Preferably a control is made during the transport so as to reject foreign material in the tobacco shreds. For example, along the pneumatic transport of shredded tobacco, a string removal conveyor system, heavy particle separator and metal detector may be present, all indicated with 205 in the appended drawing.

Mill 204 is adapted to coarse grind the tobacco strips up to a size of between about 0.25 millimetres and about 2 millimetres. The rotor speed of the mill can be controlled and changed on the basis of the tobacco shreds flow rate.

Preferably, a buffer silo 206 for uniform mass flow control, is located after the coarse grinder mill 204. Furthermore, preferably mill 204 is equipped with spark detectors and safety shut down system 207 for safety reasons.

From the mill 204, the tobacco particles are transported, for example by means of a pneumatic transport 208, to a blender 210. Blender 210 preferably includes a silo in which an appropriate valve control system is present. In the blender, all tobacco particles of all the different types of tobacco which have been selected for the predetermined blend are introduced. In the blender 210, the tobacco particles are mixed to a uniform blend. From the blender 210, the blend of tobacco particles is transported to a fine grinding station 211.

Fine grinding station 211 is for example an impact classifying mill with suitable designed ancillary equipment to produce fine tobacco powder to the right specifications, that is, to a tobacco powder between about 0.03 millimetres and about 0.12 millimetres. After the fine grinding station 211, a pneumatic transfer line 212 is adapted to transporting the fine tobacco powder to a buffer powder silo 213 for continuous feed to a downstream slurry batch mixing tank where the slurry preparation process takes place.

Figure 7:
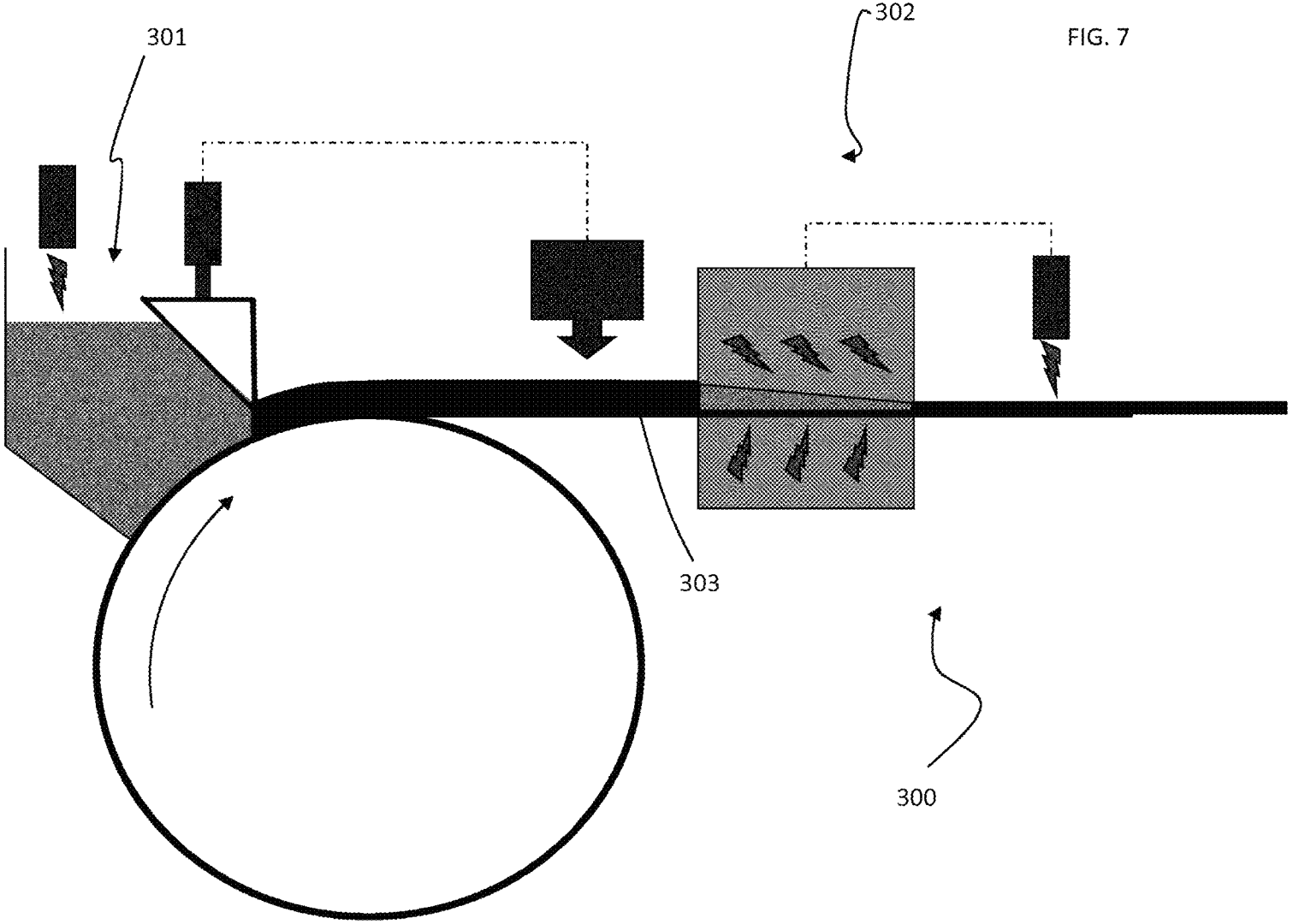
FIG. 7 shows a schematic view of an apparatus for performing the method of FIG. 3.

The slurry which has been prepared using the tobacco powder above described in steps 100-109 of the method of the invention is preferably also cast in a casting station 300 as depicted in FIG. 7.

Slurry from a buffer tank (not shown), is transferred by means of suitable pump with precision flow rate control measurement to the casting station 300. Casting station 300 comprises preferably the following sections. A precision slurry casting box and knife assembly 301 where slurry is cast onto a support 303, such as a stainless steel belt with the required uniformity and thickness for proper web formation, receives the slurry from the pump. A main dryer 302, having drying zones or sections is provided to dry the cast tobacco web. Preferably, the individual drying zones have steam heating on the bottom side of the support with heated air above the support and adjustable exhaust air control. Within the main dryer 302, the homogenized tobacco web is dried to desired final moisture on the support 303.

The invention claimed is:

1. A sheet of homogenized tobacco material, for use in a heat-not-burn aerosol-generating article, comprising powder from a tobacco blend having known proportions of graded tobacco types, said tobacco blend comprising between about 50 percent and about 100 percent of the total amount of tobacco included in the homogenized tobacco material and wherein the graded tobacco types are blended such that the reducing sugars are in an amount comprised between about 8 percent and about 18 percent in dry weight basis of the total amount of tobacco present within the homogenized tobacco material.

2. The sheet of homogenized tobacco material according to claim 1, wherein the graded tobacco types are blended so that the total ammonia is in an amount below about 0.2 percent in dry weight basis of the total amount of tobacco present within the homogenized tobacco material.

3. The sheet of homogenized tobacco material according to claim 1, wherein the graded tobacco types are blended so that the total alkaloids are in an amount comprised between about 1.5 percent and 3.5 percent in dry weight basis of the total amount of the tobacco present within the homogenized tobacco material.

4. The sheet of homogenized tobacco material according to claim 1, wherein said tobacco blend comprises at least about 30 percent of bright tobacco in dry weight basis of the total amount of tobacco included in the homogenized tobacco material.

5. The sheet of homogenized tobacco material according to claim 1, wherein said tobacco blend comprises less than about 40 percent of dark tobacco in dry weight basis of the total amount of tobacco included in the homogenized tobacco material.

6. The sheet of homogenized tobacco material according to claim 1, wherein said tobacco blend comprises less than about 40 percent of aromatic tobacco in dry weight basis of the total amount of tobacco included in the homogenized tobacco material.

7. The sheet of homogenized tobacco material according to claim 1, wherein said tobacco blend comprises less than about 20 percent of filler tobacco in dry weight basis of the total amount of tobacco included in the homogenized tobacco material.

8. The sheet of homogenized tobacco material according to claim 1, comprising cellulose fibers in an amount between about 1 percent and about 3 percent in dry weight basis of the homogenized tobacco material.

9. The sheet of homogenized tobacco material according to claim 1, comprising a binder in an amount between about 1 percent and about 5 percent in dry weight basis of the homogenized tobacco material.

10. The sheet of homogenized tobacco material according to claim 1, comprising an aerosol-former in an amount between about 5 percent and about 30 percent in dry weight basis of the homogenized tobacco material.

11. An aerosol-generating article including a portion of the sheet of homogenized tobacco material according to claim 1.

12. A batch of aerosol-generating articles according to claim 11, wherein a first target value of a first tobacco characteristic or a second target value of a second tobacco characteristic is within a predetermined tolerance range, and the tolerance range is equal to the first or second target value plus or minus about 10 percent of the first or second target value, respectively, wherein the first tobacco characteristic is reducing sugars and the second tobacco characteristic is one of total ammonia and total alkaloids.

13. The aerosol-generating article according to claim 11, wherein the aerosol-generating article is a heat-not-burn aerosol-generating article.

14. An aerosol-generating article including a portion of a sheet of homogenized tobacco material comprising powder from a tobacco blend having known proportions of graded tobacco types, the sheet realized according to a method comprising:

selecting a first target value for a first tobacco characteristic, said first tobacco characteristic being reducing sugars and the first target value being comprised between about 8 percent and about 18 percent in dry weight basis of a total amount of tobacco present within the homogenized tobacco material;

selecting a second target value of a second tobacco characteristic, wherein the second tobacco characteristic is one of total ammonia and total alkaloids;

blending the graded tobacco types so as to form a tobacco blend, each graded tobacco type comprising a predetermined amount of the first and second tobacco characteristics, so that the first and second target values of said first and second tobacco characteristics are obtained in said blend within a predetermined tolerance range;

grinding said tobacco blend into a blended tobacco powder;

forming a slurry comprising the blended tobacco powder;

forming a web of homogenous tobacco web from the slurry; and forming a sheet of homogenous tobacco material from the web.

15. A batch of aerosol-generating articles according to claim 14, wherein the first or the second target value of the first or the second tobacco characteristic, respectively, is within a predetermined tolerance range, and the tolerance range is equal to the first or second target value plus or minus about 10 percent of the selected first or second target value, respectively.

16. The aerosol-generating article according to claim 14, wherein the aerosol-generating article is a heat-not-burn aerosol-generating article.

* * * * *